US011666504B1

(12) United States Patent
Davis

(10) Patent No.: US 11,666,504 B1
(45) Date of Patent: Jun. 6, 2023

(54) COMPRESSION SLEEVE WITH MASSAGE ROLLERS

(71) Applicant: Marlon Davis, New York, NY (US)

(72) Inventor: Marlon Davis, New York, NY (US)

( * ) Notice: Subject to any disclaimer, the term of this patent is extended or adjusted under 35 U.S.C. 154(b) by 297 days.

(21) Appl. No.: 17/074,700

(22) Filed: Oct. 20, 2020

(51) Int. Cl.

| | |
|---|---|
| ***A61H 15/00*** | (2006.01) |
| ***A61H 11/02*** | (2006.01) |
| ***A61H 23/00*** | (2006.01) |
| ***A61H 7/00*** | (2006.01) |
| ***A61H 11/00*** | (2006.01) |
| ***A61H 15/02*** | (2006.01) |

(52) U.S. Cl.
CPC ..... *A61H 15/0078* (2013.01); *A61H 7/007* (2013.01); *A61H 11/02* (2013.01); *A61H 15/02* (2013.01); *A61H 23/00* (2013.01); *A61H 2011/005* (2013.01); *A61H 2015/0014* (2013.01); *A61H 2015/0064* (2013.01); *A61H 2201/0207* (2013.01); *A61H 2201/123* (2013.01); *A61H 2201/5002* (2013.01); *A61H 2201/5007* (2013.01); *A61H 2201/5066* (2013.01)

(58) Field of Classification Search
CPC ..... A61H 15/0078; A61H 7/007; A61H 11/02
See application file for complete search history.

(56) References Cited

U.S. PATENT DOCUMENTS

| | | | | |
|---|---|---|---|---|
| 6,093,164 | A | 7/2000 | Davis | |
| D610,263 | S | 2/2010 | Dagan | |
| 8,231,558 | B2 * | 7/2012 | Singh | A61M 1/3655 601/152 |
| 8,388,557 | B2 | 3/2013 | Qajar | |
| 10,874,579 | B1 * | 12/2020 | Rembert | A61H 23/006 |
| 2002/0068886 | A1 * | 6/2002 | Lin | A61H 23/0263 601/151 |
| 2002/0169398 | A1 | 11/2002 | Hancock | |
| 2005/0113724 | A1 * | 5/2005 | Wriggle | A61H 23/02 601/46 |
| 2007/0255187 | A1 | 11/2007 | Branch | |
| 2008/0200849 | A1 * | 8/2008 | Hollington | A61H 23/0263 601/134 |
| 2008/0243041 | A1 * | 10/2008 | Brenner | A61H 7/004 601/134 |
| 2010/0016768 | A1 | 1/2010 | Liu | |
| 2017/0119620 | A1 | 5/2017 | Trapp | |
| 2018/0344564 | A1 * | 12/2018 | Reiniger | A61H 7/004 |
| 2019/0328607 | A1 * | 10/2019 | Weisman | A61D 99/00 |
| 2021/0252206 | A1 * | 8/2021 | Singh | A61H 9/0092 |

* cited by examiner

*Primary Examiner* — Samchuan C Yao
*Assistant Examiner* — Nathan M Le
(74) *Attorney, Agent, or Firm* — Kyle A. Fletcher, Esq.

(57) ABSTRACT

The compression sleeve with massage rollers is a medical device. The compression sleeve with massage rollers applies a compressive pressure to an appendage of a patient. The compression sleeve with massage rollers is a mechanical device. The compression sleeve with massage rollers generates a kneading action that massages the appendage of the patient. The compression sleeve with massage rollers comprises a compression structure, a plurality of massage mechanisms, and a control circuit. The plurality of massage mechanisms and the control circuit attach to the compression structure. The control circuit electrically connects to the plurality of massage mechanisms. The control circuit controls the operation of the plurality of massage mechanisms.

16 Claims, 6 Drawing Sheets

COMPRESSION SLEEVE WITH MASSAGE ROLLERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary science including physical therapy apparatus, more specifically, a percussion or vibration massage device. (A61H23/0254)

Summary of Invention

The compression sleeve with massage rollers is a medical device. The compression sleeve with massage rollers is configured for use with a patient. The compression sleeve with massage rollers applies a compressive pressure to an appendage of the patient. The compression sleeve with massage rollers is a mechanical device. The compression sleeve with massage rollers generates a kneading action that massages the appendage of the patient. The compression sleeve with massage rollers comprises a compression structure, a plurality of massage mechanisms, and a control circuit. The plurality of massage mechanisms and the control circuit attach to the compression structure. The control circuit connects to the plurality of massage mechanisms. The control circuit controls the operation of the plurality of massage mechanisms. The compression structure applies the compressive pressure to the appendage of the patient. The plurality of massage mechanisms generates the kneading action of the compression sleeve with massage rollers.

These together with additional objects, features and advantages of the compression sleeve with massage rollers will be readily apparent to those of ordinary skill in the art upon reading the following detailed description of the presently preferred, but nonetheless illustrative, embodiments when taken in conjunction with the accompanying drawings.

In this respect, before explaining the current embodiments of the compression sleeve with massage rollers in detail, it is to be understood that the compression sleeve with massage rollers is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the compression sleeve with massage rollers.

It is therefore important that the claims be regarded as including such equivalent construction insofar as they do not depart from the spirit and scope of the compression sleeve with massage rollers. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
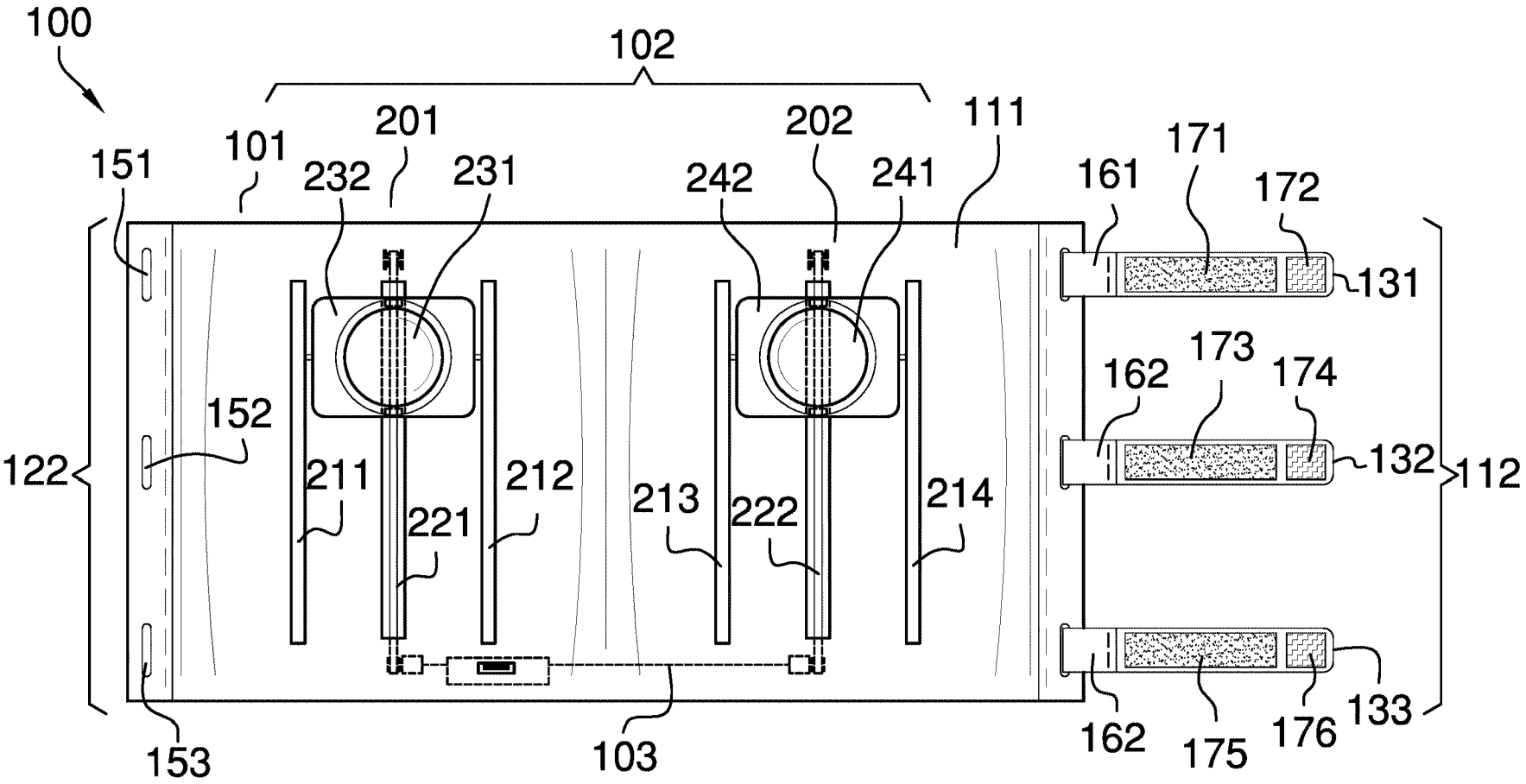
FIG. 1 is a front view of an embodiment of the disclosure.
Figure 2:
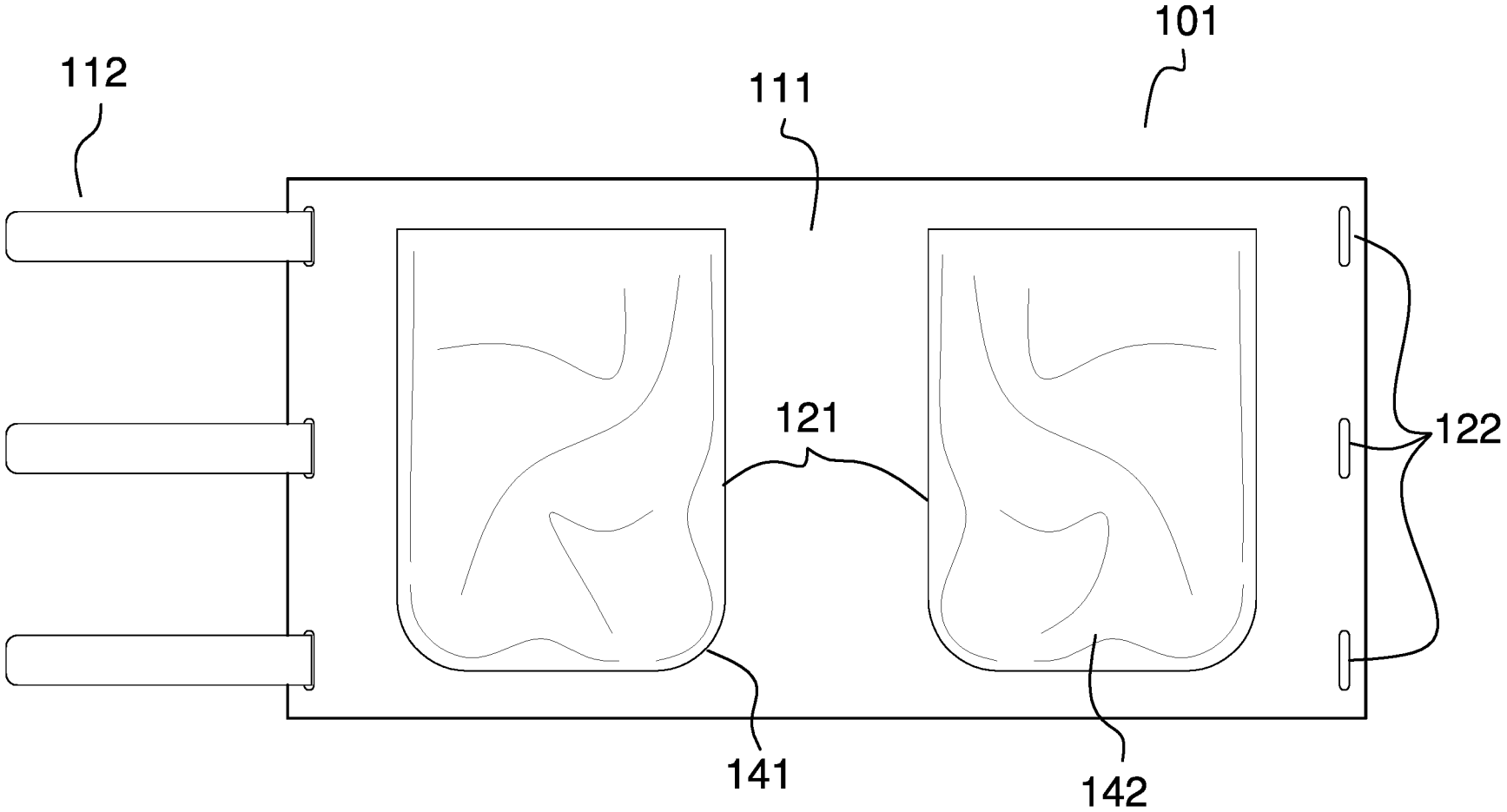
FIG. 2 is a rear view of an embodiment of the disclosure.
Figure 3:
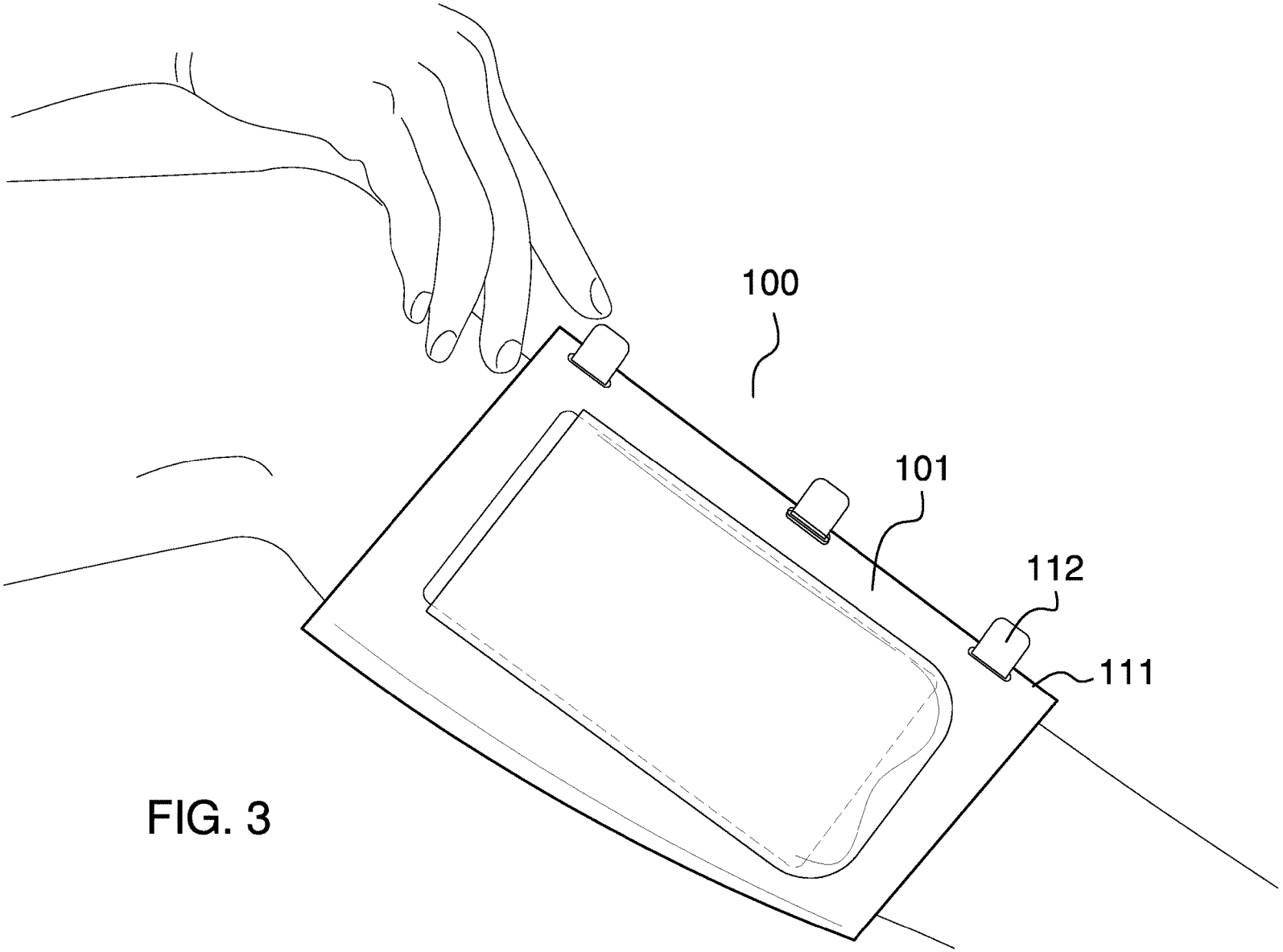
FIG. 3 is an in-use view of an embodiment of the disclosure.
Figure 4:
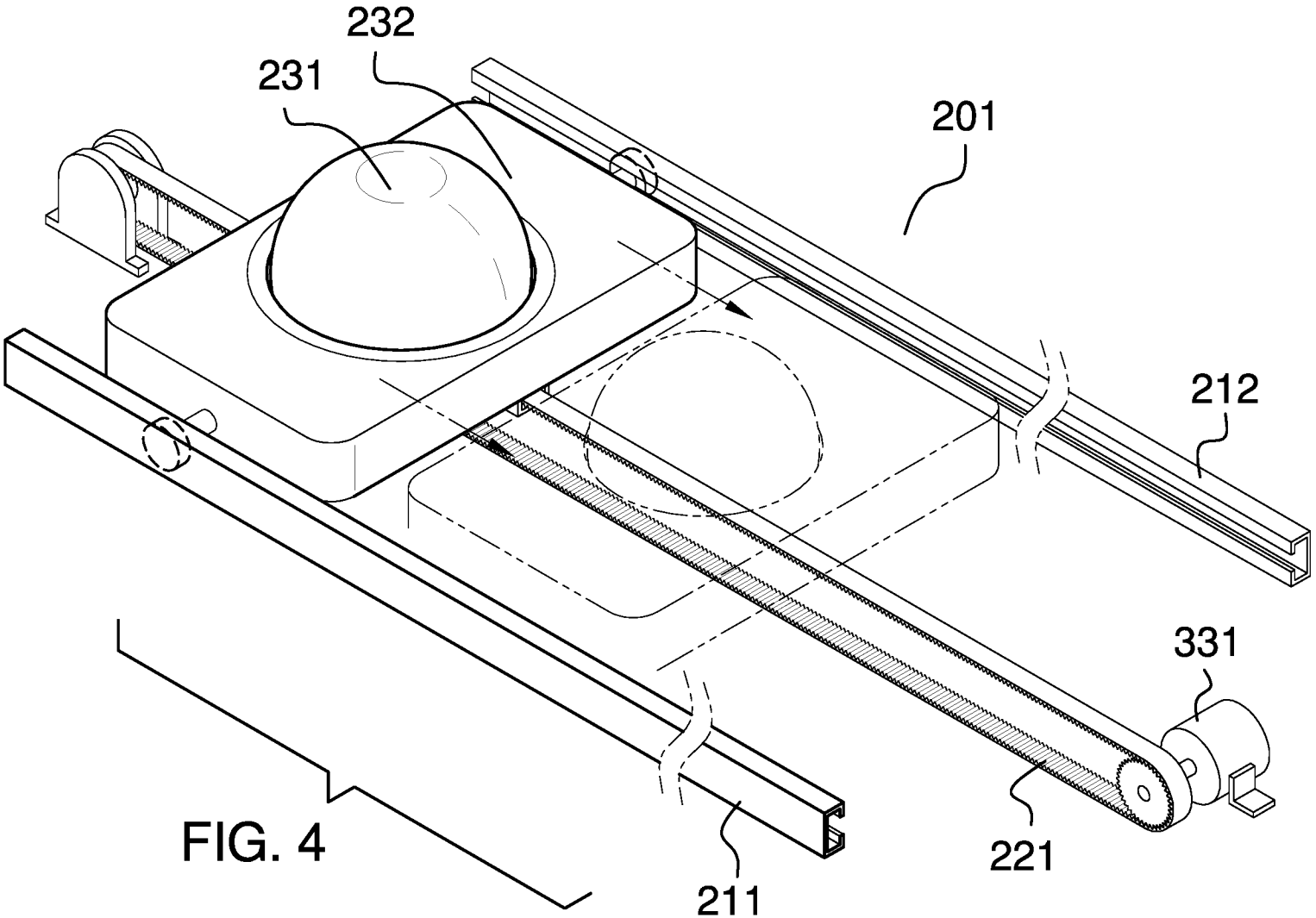
FIG. 4 is a detail view of an embodiment of the disclosure.
Figure 5:
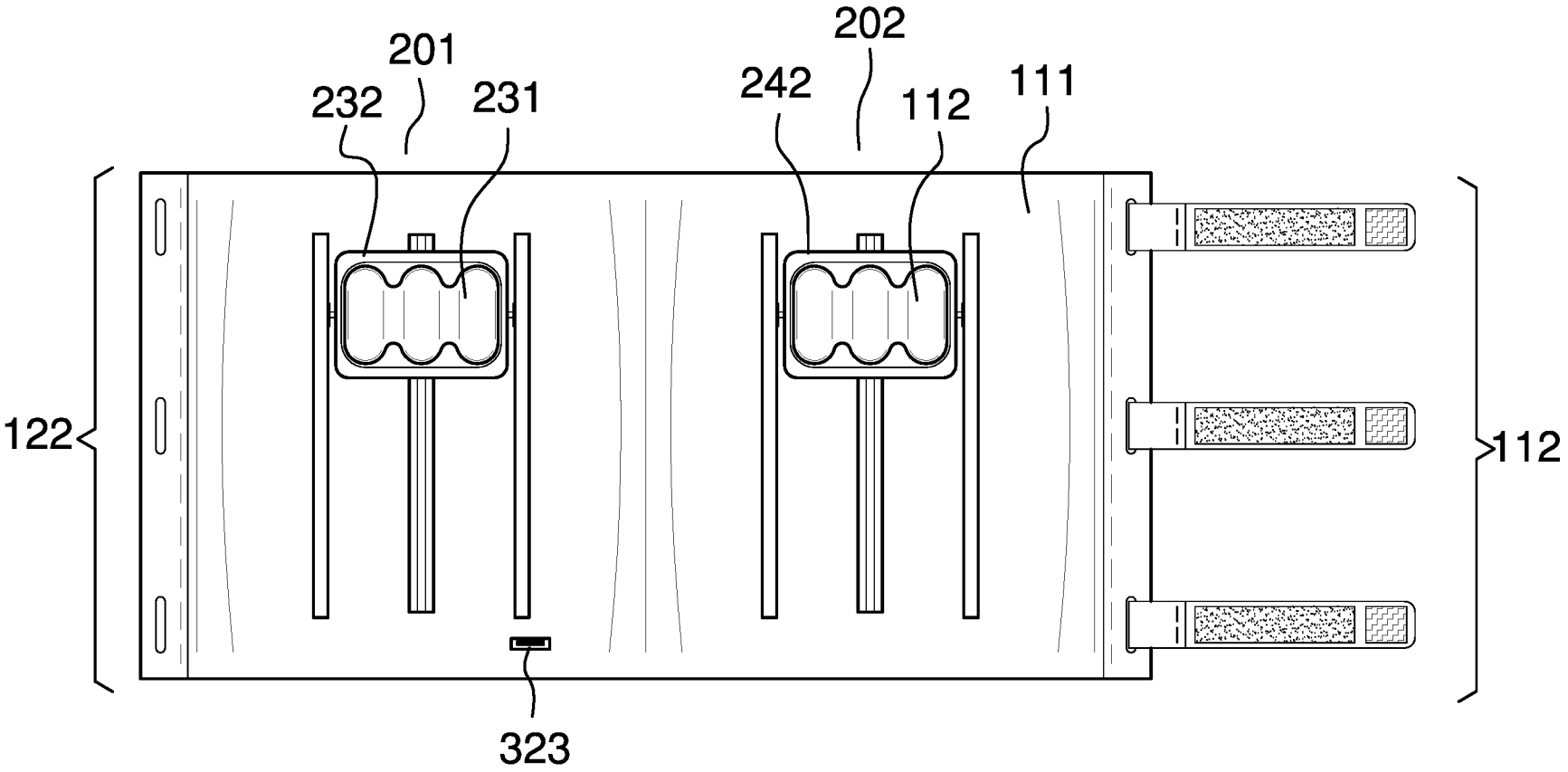
FIG. 5 is a front view of an alternate embodiment of the disclosure.
Figure 6:
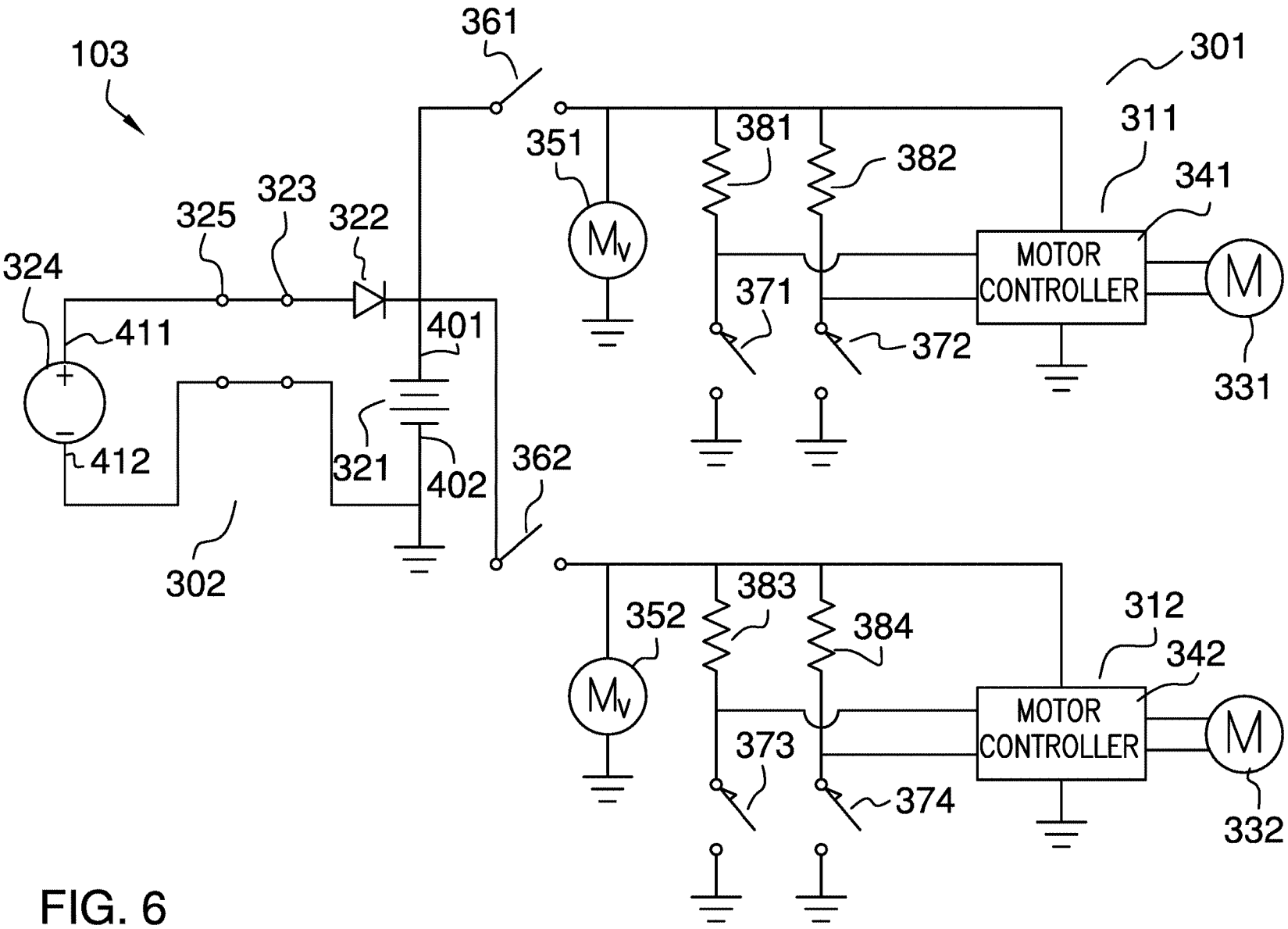
FIG. 6 is a schematic view of an embodiment of the disclosure.

Detailed reference will now be made to one or more potential embodiments of the disclosure, which are illustrated in FIGS. 1 through 6.

The compression sleeve with massage rollers 100 (hereinafter invention) is a medical device. The invention 100 is configured for use with a patient. The invention 100 applies a compressive pressure to an appendage of the patient. The invention 100 is a mechanical device. The invention 100 generates a kneading action that massages the appendage of the patient. The invention 100 comprises a compression structure 101, a plurality of massage mechanisms 102, and a control circuit 103. The plurality of massage mechanisms 102 and the control circuit 103 attach to the compression structure 101. The control circuit 103 electrically connects to the plurality of massage mechanisms 102. The control circuit 103 controls the operation of the plurality of massage mechanisms 102. The compression structure 101 applies the compressive pressure to the appendage of the patient. The plurality of massage mechanisms 102 generates the kneading action of the invention 100.

The compression structure 101 is a sheeting structure. The compression structure 101 is formed from a structure selected from the group consisting of: a) a textile structure; and, b) a polychloroprene (CAS 9010-98-4) structure. The compression structure 101 wraps around an appendage of the patient. The compression structure 101 is placed under tension such that the compression structure 101 applies pressure to the appendage of the patient. The compression structure 101 is a flexible structure such that the kneading action of the plurality of massage mechanisms 102 is transferred to the appendage of the patient through the compression structure 101. The compression structure 101 is a flexible structure such that the vibration from the control circuit 103 is transferred to the appendage of the patient through the compression structure 101. The compression structure 101 comprises a compression sheeting 111 and a plurality of hook and loop fasteners 112.

The compression sheeting 111 is a sheeting structure. The compression sheeting 111 is formed from a structure selected from the group consisting of: a) a textile structure; and, b) a polychloroprene (CAS 9010-98-4) structure. The compression sheeting 111 wraps around an appendage of the patient. The compression sheeting 111 is placed under tension such that the compression structure 101 applies pressure to the appendage of the patient. The compression sheeting 111 is a flexible structure such that the kneading action of the plurality of massage mechanisms 102 is transferred to the appendage of the patient through the compression structure 101. The compression sheeting 111 is a flexible structure such that the vibration from the control circuit 103 is transferred to the appendage of the patient through the compression structure 101. The compression sheeting 111 comprises a plurality of thermal pockets 121 and a plurality of anchor apertures 122.

Each of the plurality of thermal pockets 121 is a sheeting structure. Each of the plurality of thermal pockets 121 attaches to the face of the sheeting structure of the compression sheeting 111 that is distal from the plurality of massage mechanisms 102. Each of the plurality of thermal pockets 121 forms a pocket on the compression sheeting 111. Each of the plurality of thermal pockets 121 is configured to receive and store a thermal pack. The plurality of thermal pockets 121 comprises a first thermal pocket 141 and a second thermal pocket 142.

The first thermal pocket 141 is a textile based sheeting. The first thermal pocket 141 forms a pocket on the compression sheeting 111 that is configured to contain and hold a thermal pack against the appendage of the patient. The second thermal pocket 142 is a textile based sheeting. The second thermal pocket 142 forms a pocket on the compression sheeting 111 that is configured to contain and hold a thermal pack against the appendage of the patient.

Each of the plurality of hook and loop fasteners 112 attaches to the compression sheeting 111. Each of the plurality of hook and loop fasteners 112 attaches the compression sheeting 111 to itself such that the plurality of hook and loop fasteners 112 attaches the compression structure 101 to itself. Each of the plurality of hook and loop fasteners 112 secures the compression structure 101 to the appendage of the patient. Each of the plurality of hook and loop fasteners 112 is adjustable such that the tension on the compression sheeting 111 is adjustable. Each of the plurality of hook and loop fasteners 112 adjusts the pressure applied to the appendage of the patient by adjusting the tension on the compression sheeting 111. The plurality of hook and loop fasteners 112 comprises a first hook and loop fastener 131, a second hook and loop fastener 132, and a third hook and loop fastener 133.

The first hook and loop fastener 131 loops through the first anchor aperture 151 to secure the compression sheeting 111 to itself. The second hook and loop fastener 132 loops through the second anchor aperture 152 to secure the compression sheeting 111 to itself. The third hook and loop fastener 133 loops through the third anchor aperture 153 to secure the compression sheeting 111 to itself.

Each of the plurality of anchor apertures 122 is an aperture that is formed through the compression sheeting 111. A hook and loop fastener selected from the plurality of hook and loop fasteners 112 inserts through an anchor aperture selected from the plurality of anchor apertures 122 such that the selected hook and loop fastener loops back and attaches to itself in order to secure the compression structure 101 to the appendage of the patient. Each of the plurality of anchor apertures 122 is formed proximal to the edge of the compression sheeting 111 that is distal from the plurality of hook and loop fasteners 112. The plurality of anchor apertures 122 comprises a first anchor aperture 151, a second anchor aperture 152, and a third anchor aperture 153.

The first anchor aperture 151 is the aperture selected from the plurality of anchor apertures 122 that is sized and positioned to receive the first hook and loop fastener 131 as the first hook and loop fastener 131 secures the compression sheeting 111 to the appendage of the patient.

The second anchor aperture 152 is the aperture selected from the plurality of anchor apertures 122 that is sized and positioned to receive the second hook and loop fastener 132 as the second hook and loop fastener 132 secures the compression sheeting 111 to the appendage of the patient.

The third anchor aperture 153 is the aperture selected from the plurality of anchor apertures 122 that is sized and positioned to receive the third hook and loop fastener 133 as the third hook and loop fastener 133 secures the compression sheeting 111 to the appendage of the patient.

The first hook and loop fastener 131 comprises a first webbing 161, a first hook/loop surface 171, and a second hook/loop surface 172. The second hook and loop fastener 132 comprises a second webbing 162, a third hook/loop surface 173, and a fourth hook/loop surface 174. The third hook and loop fastener 133 comprises a third webbing 163, a fifth hook/loop surface 175, and a sixth hook/loop surface 176.

The first webbing 161 is a textile based webbing structure. The first webbing 161 receives the tension that secures the compression sheeting 111 to the appendage of the patient. The first hook/loop surface 171 and the second hook/loop surface 172 attach to the same face of the first webbing 161. The first hook/loop surface 171 is a hook/loop surface of the first hook and loop fastener 131. The second hook/loop surface 172 is a hook/loop surface of the first hook and loop fastener 131. The second hook/loop surface 172 is positioned to relative to the first hook/loop surface 171 such that the second hook/loop surface 172 presses into the first hook/loop surface 171 to secure the first hook and loop fastener 131 to the appendage of the patient. The second hook/loop surface 172 is positioned relative to the first hook/loop surface 171 such that the position of the second hook/loop surface 172 aligns with the first hook/loop surface 171 after the first webbing 161 inserts through the first anchor aperture 151 of the compression sheeting 111.

The second webbing 162 is a textile based webbing structure. The second webbing 162 receives the tension that secures the compression sheeting 111 to the appendage of the patient. The third hook/loop surface 173 and the fourth hook/loop surface 174 attach to the same face of the first webbing 161. The third hook/loop surface 173 is a hook/loop surface of the second hook and loop fastener 132. The fourth hook/loop surface 174 is a hook/loop surface of the second hook and loop fastener 132. The fourth hook/loop surface 174 is positioned to relative to the third hook/loop surface 173 such that the fourth hook/loop surface 174 presses into the third hook/loop surface 173 to secure the second hook and loop fastener 132 to the appendage of the patient. The fourth hook/loop surface 174 is positioned relative to the third hook/loop surface 173 such that the position of the fourth hook/loop surface 174 aligns with the third hook/loop surface 173 after the second webbing 162 inserts through the second anchor aperture 152 of the compression sheeting 111.

The third webbing 163 is a textile based webbing structure. The third webbing 163 receives the tension that secures the compression sheeting 111 to the appendage of the patient. The fifth hook/loop surface 175 and the sixth hook/loop surface 176 attach to the same face of the first webbing 161. The fifth hook/loop surface 175 is a hook/loop surface of the third hook and loop fastener 133. The sixth hook/loop surface 176 is a hook/loop surface of the third hook and loop fastener 133. The sixth hook/loop surface 176 is positioned to relative to the fifth hook/loop surface 175 such that the sixth hook/loop surface 176 presses into the fifth hook/loop surface 175 to secure the third hook and loop fastener 133 to the appendage of the patient. The sixth hook/loop surface 176 is positioned relative to the fifth hook/loop surface 175 such that the position of the sixth hook/loop surface 176 aligns with the fifth hook/loop surface 175 after the third webbing 163 inserts through the third anchor aperture 153 of the compression sheeting 111.

Each of the plurality of massage mechanisms 102 is a mechanical device. Each of the plurality of massage mechanisms 102 generates a kneading motion used to massage the appendage of the patient. Each of the plurality of massage mechanisms 102 attaches to a face of the sheeting structure of the compression structure 101. Each of the plurality of massage mechanisms 102 is positioned such that the compression structure 101 sits between the plurality of massage mechanisms 102 and the appendage of the patient. The plurality of massage mechanisms 102 comprises a first massage mechanism 201 and a second massage mechanism 202.

The first massage mechanism 201 is a mechanical device selected from the plurality of massage mechanisms 102. The first massage mechanism 201 generates the kneading action that massages the appendage of the patient. The control circuit 103 controls the operation of the first massage mechanism 201. The control circuit 103 provides the energy necessary to operate the first massage mechanism 201. The first massage mechanism 201 attaches to a face of the sheeting structure of the compression structure 101. The first massage mechanism 201 comprises a first track 211, a second track 212, and a first drive mechanism 221.

The first track 211 is a mechanical structure. The first track 211 attaches the first roller ball 231 housing 232 of the first massage mechanism 201 to the compression sheeting 111. The first track 211 attaches the first roller ball 231 housing 232 to the compression sheeting 111 such that the position of the first roller ball 231 housing 232 moves relative to the first track 211. The second track 212 is a mechanical structure. The second track 212 attaches the first roller ball 231 housing 232 of the first massage mechanism 201 to the compression sheeting 111. The second track 212 attaches the first roller ball 231 housing 232 to the compression sheeting 111 such that the position of the first roller ball 231 housing 232 moves relative to the second track 212. The second track 212 is parallel to the first track 211.

The first drive mechanism 221 is a belt drive. The first drive mechanism 221 attaches to the same face of the sheeting structure of the compression sheeting 111 as the first track 211 and the second track 212. The position of the first drive mechanism 221 is between the first track 211 and the second track 212. The first roller ball 231 housing 232 of the first massage mechanism 201 attaches to the first drive mechanism 221 such that the rotation of the first drive mechanism 221 moves the first roller ball 231 housing 232 relative to both the first track 211 and the second track 212. The control circuit 103 controls the direction of rotation of the first drive mechanism 221. The control circuit 103 controls the speed of rotation of the first drive mechanism 221. The first drive mechanism 221 comprises a first roller ball 231 and a first roller ball 231 housing 232.

The first roller ball 231 mounts in the first roller ball 231 housing 232 such that the first roller ball 231 rotates within the first roller ball 231 housing 232. The first roller ball 231 mounts in the first roller ball 231 housing 232 such that the first roller ball 231 in contact with the appendage of the patient. The pressure applied by the first roller ball 231 to the appendage of the patient adjusts by adjusting the tension on the compression sheeting 111. The first roller ball 231 housing 232 rolls the first roller ball 231 over the appendage of the patient. The first roller ball 231 provides the kneading that allows the first roller ball 231 to massage the appendage of the patient. In the first potential embodiment of the disclosure, the first roller ball 231 housing 232 is formed with a shape selected from the group of a spherical structure and a cylindrical structure.

The first roller ball 231 housing 232 is a rigid structure that secures the first roller ball 231 to the first track 211, the second track 212, and the first drive mechanism 221. The movement of the first roller ball 231 housing 232 along the first track 211 and the second track 212 allows the first roller ball 231 to roll over the appendage of the patient to generate the kneading action.

The second massage mechanism 202 is a mechanical device selected from the plurality of massage mechanisms 102. The second massage mechanism 202 generates the kneading action that massages the appendage of the patient. The control circuit 103 controls the operation of the second massage mechanism 202. The control circuit 103 provides the energy necessary to operate the second massage mechanism 202. The second massage mechanism 202 attaches to a face of the sheeting structure of the compression structure 101. The second massage mechanism 202 attaches to the same face of the sheeting structure of the compression structure 101 as the first massage mechanism 201. The second massage mechanism 202 is identical to the first massage mechanism 201. The second massage mechanism 202 comprises a third track 213, a fourth track 214, and a second drive mechanism 222.

The third track 213 is a mechanical structure. The third track 213 attaches the second roller ball 241 housing 242 of the second massage mechanism 202 to the compression sheeting 111.

The third track 213 attaches the second roller ball 241 housing 242 to the compression sheeting 111 such that the position of the second roller ball 241 housing 242 moves relative to the third track 213. The fourth track 214 is a mechanical structure. The fourth track 214 attaches the second roller ball 241 housing 242 of the second massage mechanism 202 to the compression sheeting 111. The fourth track 214 attaches the second roller ball 241 housing 242 to the compression sheeting 111 such that the position of the second roller ball 241 housing 242 moves relative to the fourth track 214. The fourth track 214 is parallel to the third track 213.

The second drive mechanism 222 is a belt drive. The second drive mechanism 222 attaches to the same face of the sheeting structure of the compression sheeting 111 as the third track 213 and the fourth track 214. The position of the second drive mechanism 222 is between the third track 213 and the fourth track 214. The second roller ball 241 housing 242 of the second massage mechanism 202 attaches to the second drive mechanism 222 such that the rotation of the second drive mechanism 222 moves the second roller ball 241 housing 242 relative to both the third track 213 and the fourth track 214. The control circuit 103 controls the direction of rotation of the second drive mechanism 222. The control circuit 103 controls the speed of rotation of the second drive mechanism 222. The second drive mechanism 222 comprises a second roller ball 241 and a second roller ball 241 housing 242.

The second roller ball 241 mounts in the second roller ball 241 housing 242 such that the second roller ball 241 rotates within the second roller ball 241 housing 242. The second roller ball 241 mounts in the second roller ball 241 housing 242 such that the second roller ball 241 in contact with the appendage of the patient. The pressure applied by the second roller ball 241 to the appendage of the patient adjusts by adjusting the tension on the compression sheeting 111. The second roller ball 241 housing 242 rolls the second roller ball 241 over the appendage of the patient. The second roller ball 241 provides the kneading that allows the second roller ball 241 to massage the appendage of the patient. In the first potential embodiment of the disclosure, the second roller ball 241 housing 242 is formed with a shape selected from the group of a spherical structure and a cylindrical structure.

The second roller ball 241 housing 242 is a rigid structure that secures the second roller ball 241 to the third track 213, the fourth track 214, and the second drive mechanism 222. The movement of the second roller ball 241 housing 242 along the third track 213 and the fourth track 214 allows the second roller ball 241 to roll over the appendage of the patient to generate the kneading action.

The control circuit 103 is an electric circuit. The control circuit 103 controls the operation of each of the plurality of massage mechanisms 102. The control circuit 103 provides the energy necessary to operate the plurality of massage mechanisms 102. The control circuit 103 generates a vibration that further serves to massage the appendage of the patient. The control circuit 103 is an independently powered electric circuit. By independently powered is meant that the control circuit 103 can operate without an electrical connection to an external power source 324. The control circuit 103 comprises a plurality of massage control circuits 301 and a power circuit 302. The plurality of massage control circuits 301 and the power circuit 302 are electrically interconnected.

Each of the plurality of massage control circuits 301 is an electric circuit. Each of the plurality of massage control circuits 301 controls the operation of a massage mechanism selected from the plurality of massage mechanisms 102. Each of the plurality of massage control circuits 301 controls the direction of rotation of each of the plurality of massage mechanisms 102. Each of the plurality of massage control circuits 301 controls the speed of rotation of each of the plurality of massage mechanisms 102. Each of the plurality of massage control circuits 301 controls the vibration of each of the plurality of massage control circuits 301. The plurality of massage control circuits 301 comprises a first massage control circuit 311 and a second massage control circuit 312.

The first massage control circuit 311 is an electric circuit. The first massage control circuit 311 controls the operation of the first massage mechanism 201. The first massage control circuit 311 controls the direction of rotation of the first massage mechanism 201. The first massage control circuit 311 controls the speed of rotation of the first massage mechanism 201. The first massage control circuit 311 controls the vibration of the first massage mechanism 201. The first massage control circuit 311 comprises a first electric motor 331, a first motor controller 341, a first vibration motor 351, a first master switch 361, a first limit switch 371, and a second limit switch 372. The first electric motor 331, the first motor controller 341, the first vibration motor 351, the first master switch 361, the first limit switch 371, and the second limit switch 372 are electrically interconnected. The first limit switch 371 further comprises a first pull-up resistor 381. The second limit switch 372 further comprises a second pull-up resistor 382.

The first electric motor 331 is an electric motor. The first electric motor 331 physically attaches to the first drive mechanism 221 such that the rotation of the first electric motor 331 rotates the first drive mechanism 221. The first electric motor 331 converts electrical energy into the rotational energy used to drive the first drive mechanism 221.

The first motor controller 341 is a motor controller. The motor controller is defined elsewhere in this disclosure. The first motor controller 341 controls the operation of the first electric motor 331. The first motor controller 341 controls the direction of rotation of the first electric motor 331. The first motor controller 341 controls the speed of rotation of the first electric motor 331. The first motor controller 341 controls the flow of electric energy through the first electric motor 331.

The first vibration motor 351 is an electric motor. The first vibration motor 351 is a vibration motor. The vibration motor is defined elsewhere in this disclosure. The first vibration motor 351 generates a therapeutic vibration during the operation of the first massage mechanism 201.

The first master switch 361 is a maintained switch. The maintained switch is defined elsewhere in this disclosure. The first master switch 361 electrically connects the power circuit 302 to the first massage control circuit. The first master switch 361 controls the flow of electricity from the power circuit 302 to the balance of the first massage control circuit 311. The first master switch 361 is the power switch of the first massage control circuit 311.

The first limit switch 371 is a limit switch. The limit switch is defined elsewhere in this disclosure. The first limit switch 371 detects the position of the first roller ball 231 housing 232 of the first massage mechanism 201 relative to the first track 211. The first limit switch 371 electrically connects to the first motor controller 341. The first limit switch 371 provides the control signals used by the first motor controller 341 to determine the direction of rotation of the first electric motor 331. The first pull-up resistor 381 is a resistor. The first pull-up resistor 381 electrically connects in series between the first master switch 361 and the first limit switch 371. The first pull-up resistor 381 limits the flow of electricity through the first limit switch 371.

The second limit switch 372 is a limit switch. The second limit switch 372 detects the position of the first roller ball 231 housing 232 of the first massage mechanism 201 relative to the first track 211. The second limit switch 372 electrically connects to the first motor controller 341. The second limit switch 372 provides the control signals used by the first motor controller 341 to determine the direction of rotation of the first electric motor 331. The second pull-up resistor 382 is a resistor. The second pull-up resistor 382 electrically connects in series between the first master switch 361 and the second limit switch 372. The second pull-up resistor 382 limits the flow of electricity through the second limit switch 372.

The second massage control circuit 312 is an electric circuit. The second massage control circuit 312 controls the operation of the second massage mechanism 202. The second massage control circuit 312 controls the direction of rotation of the second massage mechanism 202. The second massage control circuit 312 controls the speed of rotation of the second massage mechanism 202. The second massage control circuit 312 controls the vibration of the second massage mechanism 202. The second massage control circuit 312 comprises a second electric motor 332, a second motor controller 342, a second vibration motor 352, a second master switch 362, a third limit switch 373, and a fourth limit switch 374. The second electric motor 332, the second motor controller 342, the second vibration motor 352, the second master switch 362, the third limit switch 373, and the fourth limit switch 374 are electrically interconnected. The third limit switch 373 further comprises a third pull-up resistor 383. The fourth limit switch 374 further comprises a fourth pull-up resistor 384.

The second electric motor 332 is an electric motor. The second electric motor 332 physically attaches to the second drive mechanism 222 such that the rotation of the second electric motor 332 rotates the second drive mechanism 222. The second electric motor 332 converts electrical energy into the rotational energy used to drive the second drive mechanism 222.

The second motor controller 342 is a motor controller. The second motor controller 342 controls the operation of the second electric motor 332. The second motor controller 342 controls the direction of rotation of the second electric motor 332. The second motor controller 342 controls the speed of rotation of the second electric motor 332. The second motor controller 342 controls the flow of electric energy through the second electric motor 332.

The second vibration motor 352 is an electric motor. The second vibration motor 352 is a vibration motor. The vibration motor is defined elsewhere in this disclosure. The second vibration motor 352 generates a therapeutic vibration during the operation of the second massage mechanism 202.

The second master switch 362 is a maintained switch. The maintained switch is defined elsewhere in this disclosure. The second master switch 362 electrically connects the power circuit 302 to the second massage control circuit 312. The second master switch 362 controls the flow of electricity from the power circuit 302 to the balance of the second massage control circuit 312. The second master switch 362 is the power switch of the second massage control circuit 312.

The third limit switch 373 is a limit switch. The third limit switch 373 detects the position of the second roller ball 241 housing 242 of the second massage mechanism 202 relative to the third track 213. The third limit switch 373 electrically connects to the second motor controller 342. The third limit switch 373 provides the control signals used by the second motor controller 342 to determine the direction of rotation of the second electric motor 332. The third pull-up resistor 383 is a resistor. The third pull-up resistor 383 electrically connects in series between the second master switch 362 and the third limit switch 373. The third pull-up resistor 383 limits the flow of electricity through the third limit switch 373.

The fourth limit switch 374 is a limit switch. The fourth limit switch 374 detects the position of the second roller ball 241 housing 242 of the second massage mechanism 202 relative to the third track 213. The fourth limit switch 374 electrically connects to the second motor controller 342. The fourth limit switch 374 provides the control signals used by the second motor controller 342 to determine the direction of rotation of the second electric motor 332. The fourth pull-up resistor 384 is a resistor. The fourth pull-up resistor 384 electrically connects in series between the second master switch 362 and the fourth limit switch 374. The fourth pull-up resistor 384 limits the flow of electricity through the fourth limit switch 374.

The power circuit 302 is an electrical circuit. The power circuit 302 powers the operation of the control circuit 103. The power circuit 302 is an electrochemical device. The power circuit 302 converts chemical potential energy into the electrical energy required to power the control circuit 103. The power circuit 302 provides the electric energy to operate each of the plurality of massage control circuits 301. The power circuit 302 comprises a battery 321, a diode 322, a charging port 323, and an external power source 324. The external power source 324 further comprises a charging plug 325. The battery 321, the diode 322, the charging port 323, the external power source 324, and the charging plug 325 are electrically interconnected. The battery 321 comprises a first positive terminal 401 and a first negative terminal 402. The external power source 324 comprises a second positive terminal 411 and a second negative terminal 412.

The battery 321 is an electrochemical device. The battery 321 converts chemical potential energy into the electrical energy used to power the control circuit 103. The battery 321 is a commercially available rechargeable battery 321. The chemical energy stored within the rechargeable battery 321 is renewed and restored through the use of the charging port 323. The charging port 323 is an electrical circuit that reverses the polarity of the rechargeable battery 321 and provides the energy necessary to reverse the chemical processes that the rechargeable battery 321 initially used to generate the electrical energy. This reversal of the chemical process creates a chemical potential energy that will later be used by the rechargeable battery 321 to generate electricity.

The charging port 323 forms an electrical connection to an external power source 324 using a charging plug 325. The charging plug 325 forms a detachable electrical connection with the charging port 323. The charging port 323 receives electrical energy from the external power source 324 through the charging plug 325. The diode 322 is an electrical device that allows current to flow in only one direction. The diode 322 installs between the rechargeable battery 321 and the charging port 323 such that electricity will not flow from the first positive terminal 401 of the rechargeable battery 321 into the second positive terminal 402 of the external power source 324. In the first potential embodiment of the disclosure, the external power source 324, the charging plug 325, and the charging port 323 are compatible with USB power requirements.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Appendage: As used in this disclosure, appendage is a generic term used to describe one or more limbs of a patient.

Battery: As used in this disclosure, a battery is a chemical device consisting of one or more cells, in which chemical energy is converted into electricity and used as a source of power. Batteries are commonly defined with a positive terminal and a negative terminal.

Compress: In this disclosure, compress means to force a fixed mass of material into a smaller space.

Control Circuit: As used in this disclosure, a control circuit is an electrical circuit that manages and regulates the behavior or operation of a device.

Diode: As used in this disclosure, a diode is a two terminal semiconductor device that allows current flow in only one direction. The two terminals are called the anode and the cathode. Electric current is allowed to pass from the anode to the cathode.

Drive: As used in this disclosure, a drive is a mechanism or device that turns linear motion into rotational motion or rotational motion into linear motion.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

External Power Source: As used in this disclosure, an external power source is a source of the energy that is externally provided to enable the operation of the present disclosure. Examples of external power sources include, but are not limited to, electrical power sources and compressed air sources.

Fastener: As used in this disclosure, a fastener is a device that is used to join or affix two objects. Fasteners generally comprise a first element which is attached to the first object and a second element which is attached to the second object such that the first element and the second element join to removably attach the first object and the second object. Common fasteners include, but are not limited to, hooks, zippers, magnets, snaps, buttons, buckles, quick release buckles, or hook and loop fasteners.

Fold: As used in this disclosure, to fold means to bend an object back upon itself.

Force: As used in this disclosure, a force refers to a net (or unopposed) measurable interaction that changes the direction of motion of an object, the velocity of motion of an object, the momentum of an object, or the stress within an object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Kneading: As used in this disclosure, to knead refers to the folding, pressing a stretching of a collection of materials for the purpose of forming a uniform mass. The term kneading may further refer to a motion similar to the kneading motion that is used during massage activities.

Limit Switch: As used in this disclosure, a limit switch is an electrical switch that is actuated by a moving object that is at, or past, the position of the switch. The limit switch is used to detect the position of the moving object.

Maintained Switch: A used in this disclosure, a maintained switch is a switch that maintains the position that was set in the most recent switch actuation. A maintained switch works in an opposite manner to a momentary switch.

Massage: As used in this disclosure, a massage is a therapeutic process wherein the muscles of the body are kneaded for the purpose of aiding circulation and relaxing the muscles.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed, and the direction of rotation of an electric motor. Motor controllers will generally receive one or more inputs which are used determine the desired rotational speed and direction of rotation of the electric motor.

Neoprene: As used in this disclosure, neoprene is a popular name for polychloroprene (CAS 9010-98-4).

Normally Closed: As used in this disclosure, normally closed refers to an externally controlled electrical switching device, such as a relay or a momentary switch, which passes electric current when the externally controlled electrical switching device is in an unpowered state.

Normally Open: As used in this disclosure, normally open refers to an externally controlled electrical switching device, such as a relay or a momentary switch, which does not pass electric current when the externally controlled electrical switching device is in an unpowered state.

Patient: As used in this disclosure, a patient is a person who is designated to receive a medical treatment, therapy or service. The term patient may be extended to an animal when used within the context of the animal receiving veterinary treatment or services.

Plug: As used in this disclosure, a plug is an electrical termination that electrically connects a first electrical circuit to a second electrical circuit or a source of electricity. As used in this disclosure, a plug will have two or three metal pins.

Pocket: As used in this disclosure, a pocket is a small pouch or storage space that is formed on or into an object. Pockets are often formed by joining a second textile or a second sheeting to a first textile or a first sheeting, respectively, by sewing or heat sealing respectively. Methods to form pockets are well-known and documented in the textile and apparel arts.

Port: As used in this disclosure, a port is an electrical termination that is used to connect a first electrical circuit to a second external electrical circuit. In this disclosure, the port is designed to receive a plug.

Pressure: As used in this disclosure, pressure refers to a measure of force per unit area.

Pull-Up Resistor: As used in this disclosure, a pull-up resistor is an electrical resistor that is used to: 1) limit the current flow through a switching device; and, 2) to control the voltage level presented across a switch, a load resistor, or a pull-down resistor.

Resistance: As used in this disclosure, resistance refers to the opposition provided by an electrical circuit (or circuit element) to the electrical current created by a DC voltage is presented across the electrical circuit (or circuit element). The term impedance is often used for resistance when referring to an AC voltage that is presented across the electrical circuit (or circuit element).

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tension: As used in this disclosure, tension refers to a force applied to an object such that the force will stretch the span of length of the object along the direction of the force.

Textile: As used in this disclosure, a textile is a material that is woven, knitted, braided or felted. Synonyms in common usage for this definition include fabric and cloth. The two surfaces of the textile with the greatest surface area are called the faces of the textile.

Thermal Pack: As used in this disclosure, a thermal pack is an enclosed bag that contains a mass of material that has a high thermal capacity. The thermal pack is commonly used to rapidly warm and cool objects. A thermal pack used strictly for cooling is referred to as an ice pack. A thermal pack used strictly for heating is a hot pack.

Track: As used in this disclosure, a track is a physical structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors. A USB cable refers to a cable that: 1) is terminated with USB connectors; and, 2) that meets the data transmission standards of the USB standard.

Vibration Motor: As used in this disclosure, a vibration motor is an electric motor that rotates an unbalanced weight in such a manner that the electric motor vibrates during operation. The vibration can be varied by varying the rotational speed of the vibration motor. The rotational speed is varied by varying the electric current flowing through the vibration motor.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A compression sleeve with massage rollers comprising a compression structure, a plurality of massage mechanisms, and a control circuit;

wherein the compression sleeve with massage rollers is a medical device;

wherein the compression sleeve with massage rollers is configured for use with a patient;

wherein the compression sleeve with massage rollers applies a compressive pressure to an appendage of the patient;

wherein the compression sleeve with massage rollers is a mechanical device; wherein the compression sleeve with massage rollers generates a kneading action that massages the appendage of the patient;

wherein the control circuit comprises a plurality of massage control circuits and a power circuit; wherein the plurality of massage control circuits comprises a first massage control circuit and a second massage control circuit;

wherein the first massage control circuit controls the operation of a first massage mechanism of the plurality of massage mechanism;

wherein the second massage control circuit controls the operation of a second massage mechanism of the plurality of massage mechanism;

wherein the first massage control circuit comprises a first electric motor, a first motor controller, a first vibration motor, a first master switch, a first limit switch, and a second limit switch; wherein the first limit switch further comprises a first pull-up resistor;

wherein the second limit switch further comprises a second pull-up resistor;

wherein the second massage control circuit comprises a second electric motor, a second motor controller, a second vibration motor, a second master switch, a third limit switch, and a fourth limit switch; wherein the third limit switch further comprises a third pull-up resistor; wherein the fourth limit switch further comprises a fourth pull-up resistor;

wherein the power circuit powers the operation of the control circuit; wherein the power circuit converts chemical potential energy into the electrical energy required to power the control circuit; wherein the power circuit provides the electric energy to operate each of the plurality of massage control circuits;

wherein the power circuit comprises a battery, a diode, a charging port, and an external power source; wherein the external power source further comprises a charging plug;

wherein the battery comprises a first positive terminal and a first negative terminal;

wherein the external power source comprises a second positive terminal and a second negative terminal;

wherein the first massage mechanism attaches to the face of the compression structure;

wherein the first massage mechanism comprises a first track, a second track, and a first drive mechanism; wherein the first track is a mechanical structure;

wherein the first track attaches a first roller ball housing of the first massage mechanism to the compression sheeting; wherein the first track attaches the first roller ball housing to the compression sheeting such that the position of the first roller ball housing moves relative to the first track;

wherein the second track is a mechanical structure; wherein the second track attaches the first roller ball housing of the first massage mechanism to the compression sheeting;

wherein the second track attaches the first roller ball housing to the compression sheeting such that the position of the first roller ball housing moves relative to the second track;

wherein the second track is parallel to the first track;

wherein the first drive mechanism is a belt drive; wherein the first drive mechanism attaches to the same face of the compression sheeting as the first track and the second track;

wherein the position of the first drive mechanism is between the first track and the second track;

wherein the first roller ball housing of the first massage mechanism attaches to the first drive mechanism such that the rotation of the first drive mechanism moves the first roller ball housing relative to both the first track and the second track;

wherein the control circuit controls the direction of rotation of the first drive mechanism; and wherein the control circuit controls the speed of rotation of the first drive mechanism.

2. The compression sleeve with massage rollers according to claim wherein the plurality of massage mechanisms and the control circuit attach to the compression structure;

wherein the control circuit connects to the plurality of massage mechanisms;

wherein the control circuit controls the operation of the plurality of massage mechanisms;

wherein the compression structure applies the compressive pressure to the appendage of the patient;

wherein the plurality of massage mechanisms generates the kneading action of the compression sleeve with massage rollers;

wherein the compression structure wraps around an appendage of the patient;

wherein the compression structure is placed under tension such that the compression structure applies pressure to the appendage of the patient;

wherein the compression structure is a flexible structure such that the kneading action of the plurality of massage mechanisms is transferred to the appendage of the patient through the compression structure;

wherein the compression structure is a flexible structure such that a vibration from the control circuit is transferred to the appendage of the patient through the compression structure.

3. The compression sleeve with massage rollers according to claim 2 wherein each of the plurality of massage mechanisms is a mechanical device;

wherein each of the plurality of massage mechanisms generates a kneading motion used to massage the appendage of the patient;

wherein each of the plurality of massage mechanisms attaches to the face of the sheeting structure of the compression structure;

wherein each of the plurality of massage mechanisms is positioned such that the compression structure sits between the plurality of massage mechanisms and the appendage of the patient.

4. The compression sleeve with massage rollers according to claim 3 wherein the compression structure comprises a compression sheeting and a plurality of hook and loop fasteners;

wherein the plurality of hook and loop fasteners attach to the compression sheeting.

5. The compression sleeve with massage rollers according to claim 4 wherein the control circuit is an electric circuit;

wherein the control circuit controls the operation of each of the plurality of massage mechanisms;

wherein the control circuit provides the energy necessary to operate the plurality of massage mechanisms;

wherein the control circuit generates the vibration that further serves to massage the appendage of the patient;

wherein the control circuit is an independently powered electric circuit;

wherein by independently powered is meant that the control circuit can operate without an electrical connection to an external power source.

6. The compression sleeve with massage rollers according to claim 5 wherein the plurality of massage mechanisms comprises a first massage mechanism and a second massage mechanism;

wherein the first massage mechanism is a mechanical device selected from the plurality of massage mechanisms;

wherein the first massage mechanism generates the kneading action that massages the appendage of the patient;

wherein the second massage mechanism is a mechanical device selected from the plurality of massage mechanisms;

wherein the second massage mechanism generates the kneading action that massages the appendage of the patient;

wherein the control circuit controls the operation of the first massage mechanism;

wherein the control circuit provides the energy necessary to operate the first massage mechanism;

wherein the control circuit controls the operation of the second massage mechanism;

wherein the control circuit provides the energy necessary to operate the second massage mechanism.

7. He compression sleeve with massage rollers according to claim 6, wherein the compression sheeting comprises a plurality of thermal pockets and a plurality of anchor apertures;

wherein each of the plurality of thermal pockets attaches to the face of the compression sheeting that is distal from the plurality of massage mechanisms;

wherein each of the plurality of hook and loop fasteners attaches to the compression sheeting; wherein each of the plurality of hook and loop fasteners attaches the compression sheeting to itself such that the plurality of hook and loop fasteners attaches the compression structure to itself;

wherein each of the plurality of hook and loop fasteners secures the compression structure to the appendage of the patient;

wherein each of the plurality of hook and loop fasteners is adjustable such that the tension on the compression sheeting is adjustable;

wherein each of the plurality of hook and loop fasteners adjusts the pressure applied to the appendage of the patient by adjusting the tension on the compression sheeting;

wherein each of the plurality of anchor apertures is an aperture that is formed through the compression sheeting;

wherein a hook and loop fastener selected from the plurality of hook and loop fasteners inserts through an anchor aperture selected from the plurality of anchor apertures such that the selected hook and loop fastener loops back and attaches to itself in order to secure the compression structure to the appendage of the patient;

wherein each of the plurality of anchor apertures is formed proximal to the edge of the compression sheeting that is distal from the plurality of hook and loop fasteners.

8. The compression sleeve with massage rollers according to claim 7 wherein the plurality of hook and loop fasteners comprises a first hook and loop fastener, a second hook and loop fastener, and a third hook and loop fastener;

wherein the plurality of anchor apertures comprises a first anchor aperture, a second anchor aperture, and a third anchor aperture;

wherein the first hook and loop fastener loops through the first anchor aperture to secure the compression sheeting to itself;

wherein the second hook and loop fastener loops through the second anchor aperture to secure the compression sheeting to itself;

wherein the third hook and loop fastener loops through the third anchor aperture to secure the compression sheeting to itself;

wherein the first anchor aperture is the aperture selected from the plurality of anchor apertures that is sized and positioned to receive the first hook and loop fastener as the first hook and loop fastener secures the compression sheeting to the appendage of the patient;

wherein the second anchor aperture is the aperture selected from the plurality of anchor apertures that is sized and positioned to receive the second hook and loop fastener as the second hook and loop fastener secures the compression sheeting to the appendage of the patient;

wherein the third anchor aperture is the aperture selected from the plurality of anchor apertures that is sized and positioned to receive the third hook and loop fastener as the third hook and loop fastener secures the compression sheeting to the appendage of the patient.

9. The compression sleeve with massage rollers according to claim 8 wherein the second massage mechanism attaches to the face of the compression structure; wherein the second massage mechanism attaches to the same face of the compression structure as the first massage mechanism;

wherein the second massage mechanism is identical to the first massage mechanism;

wherein the second massage mechanism comprises a third track, a fourth track, and a second drive mechanism; wherein the third track is a mechanical structure;

wherein the third track attaches a second roller ball housing of the second massage mechanism to the compression sheeting; wherein the third track attaches the second roller ball housing to the compression sheeting such that the position of the second roller ball housing moves relative to the third track;

wherein the fourth track is a mechanical structure; wherein the fourth track attaches the second roller ball housing of the second massage mechanism to the compression sheeting;

wherein the fourth track attaches the second roller ball housing to the compression sheeting such that the position of the second roller ball housing moves relative to the fourth track;

wherein the fourth track is parallel to the third track;

wherein the second drive mechanism is a belt drive; wherein the second drive mechanism attaches to the same face of the compression sheeting as the third track and the fourth track;

wherein the position of the second drive mechanism is between the third track and the fourth track;

wherein the second roller ball housing of the second massage mechanism attaches to the second drive mechanism such that the rotation of the second drive mechanism moves the second roller ball housing relative to both the third track and the fourth track;

wherein the control circuit controls the direction of rotation of the second drive mechanism; wherein the control circuit controls the speed of rotation of the second drive mechanism.

10. The compression sleeve with massage rollers according to claim 9 wherein the first drive mechanism comprises a first roller ball and the first roller ball housing;

wherein the first roller ball mounts in the first roller ball housing such that the first roller ball rotates within the first roller ball housing;

wherein the first roller ball mounts in the first roller ball housing such that the first roller ball in contact with the appendage of the patient;

wherein the pressure applied by the first roller ball to the appendage of the patient adjusts by adjusting the tension on the compression sheeting;

wherein the first roller ball housing rolls the first roller ball over the appendage of the patient;

wherein the first roller ball provides the kneading that allows the first roller ball to massage the appendage of the patient;

wherein, the first roller ball housing is formed with a shape selected from the group of a spherical structure and a cylindrical structure;

wherein the first roller ball housing is a rigid structure that secures the first roller ball to the first track, the second track, and the first drive mechanism;

wherein the movement of the first roller ball housing along the first track and the second track allows the first roller ball to roll over the appendage of the patient to generate the kneading action;

wherein the second drive mechanism comprises a second roller ball and the second roller ball housing;

wherein the second roller ball mounts in the second roller ball housing such that the second roller ball rotates within the second roller ball housing;

wherein the second roller ball mounts in the second roller ball housing such that the second roller ball in contact with the appendage of the patient;

wherein the pressure applied by the second roller ball to the appendage of the patient adjusts by adjusting the tension on the compression sheeting;

wherein the second roller ball housing rolls the second roller ball over the appendage of the patient;

wherein the second roller ball provides the kneading that allows the second roller ball to massage the appendage of the patient;

wherein, the second roller ball housing is formed with a shape selected from the group of a spherical structure and a cylindrical structure;

wherein the second roller ball housing is a rigid structure that secures the second roller ball to the third track, the fourth track, and the second drive mechanism;

wherein the movement of the second roller ball housing along the third track and the fourth track allows the second roller ball to roll over the appendage of the patient to generate the kneading action.

11. The compression sleeve with massage rollers according to claim 10 wherein each of the plurality of massage control circuits is an electric circuit;

wherein each of the plurality of massage control circuits controls the operation of a massage mechanism selected from the plurality of massage mechanisms;

wherein each of the plurality of massage control circuits controls the direction of rotation of each of the plurality of massage mechanisms;

wherein each of the plurality of massage control circuits controls the speed of rotation of each of the plurality of massage mechanisms;

wherein each of the plurality of massage control circuits controls the vibration of each of the plurality of massage control circuits.

12. The compression sleeve with massage rollers according to claim 11 wherein the plurality of massage control circuits comprises the first massage control circuit and the second massage control circuit;

wherein the first massage control circuit is an electric circuit;

wherein the first massage control circuit controls the operation of the first massage mechanism;

wherein the first massage control circuit controls the direction of rotation of the first massage mechanism;

wherein the first massage control circuit controls the speed of rotation of the first massage mechanism;

wherein the first massage control circuit controls the vibration of the first massage mechanism;

wherein the second massage control circuit controls the direction of rotation of the second massage mechanism;

wherein the second massage control circuit controls the speed of rotation of the second massage mechanism;

wherein the second massage control circuit controls the vibration of the second massage mechanism.

13. The compression sleeve with massage rollers according to claim 12 wherein the first electric motor is an electric motor;

wherein the first electric motor physically attaches to the first drive mechanism such that the rotation of the first electric motor rotates the first drive mechanism;

wherein the first electric motor converts electrical energy into the rotational energy used to drive the first drive mechanism;

wherein the first motor controller is a motor controller;

wherein the first motor controller controls the operation of the first electric motor;

wherein the first motor controller controls the direction of rotation of the first electric motor;

wherein the first motor controller controls the speed of rotation of the first electric motor;

wherein the first motor controller controls the flow of electric energy through the first electric motor;

wherein the first vibration motor is an electric motor;

wherein the first vibration motor is a vibration motor;

wherein the first master switch is a maintained switch;

wherein the first master switch electrically connects the power circuit to the first massage control circuit;

wherein the first master switch controls the flow of electricity from the power circuit to the balance of the first massage control circuit;

wherein the first master switch is the power switch of the first massage control circuit;

wherein the first limit switch is a limit switch;

wherein the first limit switch detects the position of the first roller ball housing of the first massage mechanism relative to the first track;

wherein the first limit switch electrically connects to the first motor controller;

wherein the first limit switch provides the control signals used by the first motor controller to determine the direction of rotation of the first electric motor;

wherein the first pull-up resistor is a resistor;

wherein the first pull-up resistor electrically connects in series between the first master switch and the first limit switch;

wherein the first pull-up resistor limits the flow of electricity through the first limit switch;

wherein the second limit switch is a limit switch;

wherein the second limit switch detects the position of the first roller ball housing of the first massage mechanism relative to the first track;

wherein the second limit switch electrically connects to the first motor controller;

wherein the second limit switch provides the control signals used by the first motor controller to determine the direction of rotation of the first electric motor;

wherein the second pull-up resistor is a resistor;

wherein the second pull-up resistor electrically connects in series between the first master switch and the second limit switch;

wherein the second pull-up resistor limits the flow of electricity through the second limit switch.

14. The compression sleeve with massage rollers according to claim 13 wherein the second electric motor is an electric motor;

wherein the second electric motor physically attaches to the second drive mechanism such that the rotation of the second electric motor rotates the second drive mechanism;

wherein the second electric motor converts electrical energy into the rotational energy used to drive the second drive mechanism;

wherein the second motor controller is a motor controller;

wherein the second motor controller controls the operation of the second electric motor;

wherein the second motor controller controls the direction of rotation of the second electric motor;

wherein the second motor controller controls the speed of rotation of the second electric motor;

wherein the second motor controller controls the flow of electric energy through the second electric motor;

wherein the second vibration motor is an electric motor;

wherein the second vibration motor is a vibration motor;

wherein the second vibration motor generates a therapeutic vibration during the operation of the second massage mechanism;

wherein the second master switch is a maintained switch;

wherein the second master switch electrically connects the power circuit to the second massage control circuit;

wherein the second master switch controls the flow of electricity from the power circuit to the balance of the second massage control circuit;

wherein the second master switch is the power switch of the second massage control circuit;

wherein the third limit switch is a limit switch;

wherein the third limit switch detects the position of the second roller ball housing of the second massage mechanism relative to the third track;

wherein the third limit switch electrically connects to the second motor controller;

wherein the third limit switch provides the control signals used by the second motor controller to determine the direction of rotation of the second electric motor;

wherein the third pull-up resistor is a resistor;

wherein the third pull-up resistor electrically connects in series between the second master switch and the third limit switch;

wherein the third pull-up resistor limits the flow of electricity through the third limit switch;

wherein the fourth limit switch is a limit switch;

wherein the fourth limit switch detects the position of the second roller ball housing of the second massage mechanism relative to the third track;

wherein the fourth limit switch electrically connects to the second motor controller;

wherein the fourth limit switch provides the control signals used by the second motor controller to determine the direction of rotation of the second electric motor;

wherein the fourth pull-up resistor is a resistor;

wherein the fourth pull-up resistor electrically connects in series between the second master switch and the fourth limit switch;

wherein the fourth pull-up resistor limits the flow of electricity through the fourth limit switch.

15. The compression sleeve with massage rollers according to claim 14 wherein the battery is a rechargeable battery;

wherein the charging port is an electrical circuit that reverses the polarity of the rechargeable battery and provides the energy necessary to reverse the chemical processes that the rechargeable battery initially used to generate the electrical energy;

wherein this reversal of the chemical process creates a chemical potential energy that will later be used by the rechargeable battery to generate electricity;

wherein the charging port forms an electrical connection to an external power source using a charging plug;

wherein the charging plug forms a detachable electrical connection with the charging port;

wherein the charging port receives electrical energy from the external power source through the charging plug;

wherein the diode is an electrical device that allows current to flow in only one direction;

wherein the diode installs between the rechargeable battery and the charging port such that electricity will not flow from the first positive terminal of the rechargeable battery into the second positive terminal of the external power source.

16. The compression sleeve with massage rollers according to claim 15 wherein each of the plurality of thermal pockets is a sheeting structure;

wherein each of the plurality of thermal pockets forms a pocket on the compression sheeting;

wherein each of the plurality of thermal pockets is configured to receive and store a thermal pack;

wherein the plurality of thermal pockets comprises a first thermal pocket and a second thermal pocket;

wherein the first thermal pocket is a textile based sheeting;

wherein the first thermal pocket forms a pocket on the compression sheeting that is configured to contain and hold a thermal pack against the appendage of the patient;

wherein the second thermal pocket is a textile based sheeting;

wherein the second thermal pocket forms a pocket on the compression sheeting that is configured to contain and hold a thermal pack against the appendage of the patient.

* * * * *